United States Patent [19]

Sonnberger

[11] 4,223,761

[45] Sep. 23, 1980

[54] APPARATUS FOR DESCENDING A ROPE

[76] Inventor: Walter Sonnberger, Dietmannsdorf 13, A 8181 St. Ruprecht, Raab, Austria

[21] Appl. No.: 9,798

[22] Filed: Feb. 6, 1979

[51] Int. Cl.[2] ..... A62B 1/14

[52] U.S. Cl. ..... 182/5; 188/65.5

[58] Field of Search ..... 182/5, 6, 7, 192, 191, 182/10; 188/65.5, 65.4

[56] References Cited

U.S. PATENT DOCUMENTS

| | | | |
|---|---|---|---|
| 682,869 | 9/1901 | Hammerly | 188/65.5 |
| 778,743 | 12/1904 | Ewers | 188/65.5 |
| 917,681 | 4/1909 | Thompson | 188/65.5 |
| 2,073,312 | 3/1937 | Miller | 182/7 |
| 3,739,875 | 6/1973 | Clark et al. | 182/6 |
| 4,114,726 | 9/1978 | Sentinelle | 188/65.5 |

FOREIGN PATENT DOCUMENTS

| | | | |
|---|---|---|---|
| 651290 | 7/1974 | Belgium | 182/5 |

*Primary Examiner*—Reinaldo P. Machado
*Attorney, Agent, or Firm*—Karl F. Ross

[57] ABSTRACT

An apparatus for descending a rope or cable has a pair of laterally spaced housing parts pivoted together at their upper regions and connected at their lower regions to the upper ends of a scissor linkage provided at its lower ends with a pair of handles. Each of the housing parts carries a plurality of rollers engageable with the rope or cable and engaged by respective brakes for slowing descent of the device down such a rope or cable. One of the handles carries an operating lever connected to at least one of the brakes for reducing the braking force and increasing descent speed when this lever is operated.

10 Claims, 4 Drawing Figures

APPARATUS FOR DESCENDING A ROPE

FIELD OF THE INVENTION

The present invention relates to an apparatus for descending a vertical strand such as a rope or cable. More particularly this invention concerns such an apparatus normally used in the event of a fire to allow a person safely to descend an escape rope or cable, or as a device usable for mountain climbing, construction work and other purposes.

BACKGROUND OF THE INVENTION

Descending a vertical strand, such as a rope or cable, is normally a task that can only be accomplished with some degree of safety by a skilled mountaineer or the like. Thus when a rope is provided as an emergency egress from an upper story of a building or when for some other purpose a person must descend a rope for some considerable distance, it is necessary to provide an apparatus to make such descent not only possible but relatively safe. To this end the apparatus must normally slide along the rope and must normally incorporate some sort of brake to allow a relatively slow rate of descent.

Accordingly Austrian Pat. No. 20,548 shows a device wherein the rope is guided and gripped between a pair of bars whose upper ends are pivoted on a common horizontal element and whose lower ends are connected to a ring. The bars are curved away from each other so that a downward pull on the ring pulls them toward each other so that rough inner surfaces of these arcuate bars will come into contact with the rope or cable and frictionally brake same. This arrangement has the considerable disadvantage that the braking force applied is directly related to the size of the load the devices carry, so that if the load is too light, relative to the coefficient of friction between the bars and the rope, little effective braking will be achieved, yet if the load is too heavy the brake will completely stop on the cable.

Another arrangement is shown in German Pat. No. 233,010. Here the rope or cable is gripped between two rollers carried on one housing part and two other rollers carried on another housing part that is hinged on the one housing part about a horizontal axis parallel to the roller axes. A two-arm lever is pivoted on the bottom of the one housing end and is effective upwardly on the other housing half to press the rollers tightly together and pinch the rope, and carries on its other end an eye for supporting the load. Such an arrangement allows a limited variation of the braking capacity, yet nonetheless is rather dangerous in use, as only limited braking capacity is present, and the operation of the device is a relatively sensitive chore. Consequently the user might descend much too fast or much too slowly.

British Pat. No. 100,942 shows another arrangement wherein a pair of gripping members can be forced inwardly against the rope by means of a pair of levers that are pulled downwardly by the load and hold each other by a spring. This arrangement, once again, has the disadvantage that the braking force is exclusively determined by the size of the load. Furthermore the amount of braking and type of braking can hardly be varied, and the arrangement can only work with strands having diameters lying within a relatively narrow range. This patent also shows a two-handled device having rollers, but nonetheless only operable with strands of a relatively limited size range.

Finally an arrangement can be seen in U.S. Pat. No. 3,739,875 wherein two sets of rollers pinch a rope. The rotation speed of at least one of the sets of rollers is limited by a governor, and a brake that can be controlled by the user is effective on the other rollers. This arrangement is relatively complex. Once again the disadvantage of it is that it can only be used with a rope whose size lies within a very limited range. The rollers are spaced so that a rope that is too thick can not even be fitted between them, whereas a rope that is too thin will not be effectively braked at all.

OBJECTS OF THE INVENTION

It is therefore an object of the present invention to provide an improved apparatus for descending a strand such as a rope or cable.

Another object is to provide such an apparatus which can be used on strands whose diameters vary widely, and can even be used on a strand having splices that constitute short thickenings that normally would jam the above-described prior-art device.

A further object is to provide such an apparatus which is relatively simple to use and which can be produced at relatively low cost.

SUMMARY OF THE INVENTION

These objects are attained according to the instant invention in an apparatus having a pair of housing parts pivoted together about a horizontal upper pivot axis. Each housing part has a plurality of rollers that can be braked and that engage respective sides of the strand engaged between the housing parts. A scissor linkage has a pair of lower ends which are provided with handles and from which the load can be suspended, and a pair of upper ends each attached to a respecive lower end of the housing. In addition an operating lever for at least one of the brakes is provided to allow the user to reduce the amount of braking as desired.

According to this invention the scissor linkage comprises a pair of first links that cross each other and that are pivoted together at their intersection. These first links have upper ends pivoted on their respective housing parts and lower ends pivoted on the upper ends of second links whose lower ends are pivoted together at an eye from which the load is suspended. The handles are provided on these second links. The braking force is normally set in such an arrangement so that when the operating lever for the brake is not actuated the force is so great that the device will not descend along the rope. Only by actuating the operating lever is the braking force reduced sufficiently to allow the device to descend.

In accordance with another feature of this invention the entire scissor linkage is pivoted on the lower end of the housing parts about a horizontal axis perpendicular to the pivot axis between the upper ends of the two housing parts. Thus the entire scissor linkage and load can swing somewhat relative to the housing parts.

The brakes according to this invention can be a plurality of shoes urged by means of a common spring against the wheels or rollers that engage and guide the rope or strand. The operating lever is connected via a Bowden cable and lever to this arrangement so that when the operating lever is actuated, normally by pulling toward the respective handle, the braking force is relieved somewhat.

It is also possible in accordance with this invention to provide a plurality of separate brake shoes each pivoted on the housing. Some of these brake shoes are pivoted, relative to the normal direction of rotation of the rollers on the center of the device, at a location ahead of their braking faces and some at locations behind. These latter brake shoes are therefore self-tightening. Such an arrangement can be operated generally in the manner described above, but with the lever that is operated by the Bowden cable connected to its one end and its other end acting as the abutment for the above-mentioned spring. This spring bears at its other end on a two-arm lever pivoted on one of the brake shoes and connected via a link to another two-arm lever carried on another brake shoe effective in the opposite direction. The other end of this second two-arm lever is connected via a link to yet another brake shoe so that when the main lever connected to the Bowden cable is tipped the spring force with be increased and all of the brake shoes will bear with a balanced and increased force on their respective wheels. Such a system ensures that force is evenly distributed over all of the rollers so that no one of the individual brake shoes will wear out more rapidly than another, and overall a good service life will be obtained.

Normally all of the rollers on one housing part are continuously braked with a settable braking force that does not vary during normal operation of the machine. The brakes of the rollers of the other housing part, however, are normally effective with a force sufficient to stop the descent of the device, yet this braking force can be lessened according to this invention.

As the pivot according to this invention is relatively far above the uppermost roller, strands having a diameter lying in a relatively large range can be used. The force with which the one housing part is urged toward the other is directly related to the amount of downward force effective on the scissor linkage, that the possibility of variation allows extremely easy and convenient operation.

SPECIFIC DESCRIPTION

Figure 1:
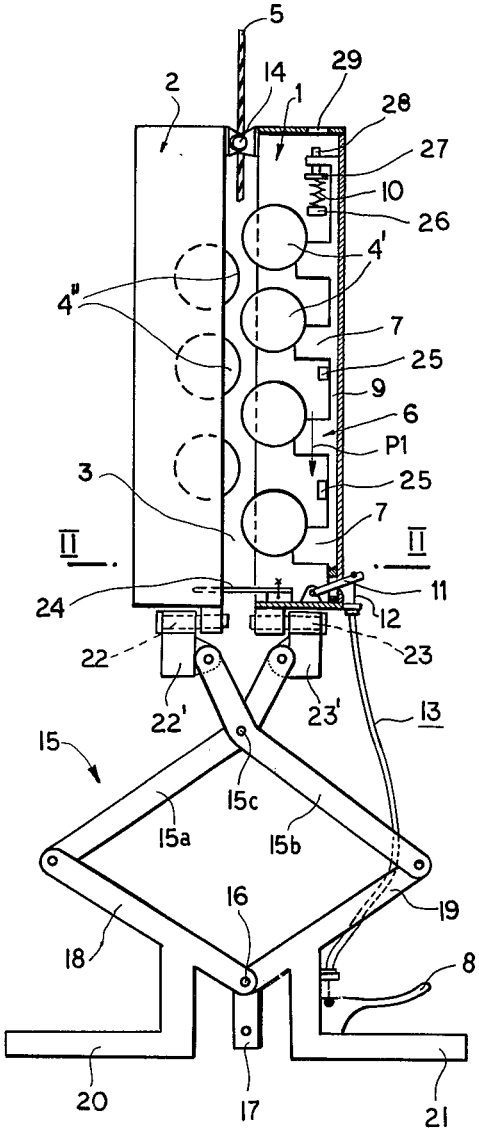
FIG. 1 is a side partly sectional view of an apparatus according to this invention.
Figure 2:
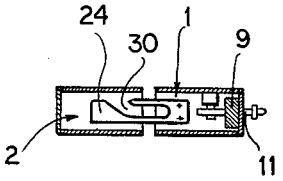
FIG. 2 is a section taken along line II—II of FIG. 1.

As shown in FIGS. 1 and 2 an apparatus according to this invention used for descending a rope or strand 5 has a pair of housing parts 1 and 2 together defining a central space 3 and provided with respective rollers 4' and 4''. Both sets of these rollers 4' and 4'' are braked by a brake 6, only one of which is shown. The brake 6 for the rollers 4'' is set before use and its braking force cannot be varied. The other brake 6 visible in FIG. 1 also normally operates with a set braking force, but this braking force can be lessened as will be described below.

The brake 6 is actually constituted by four brake shoes or blocks 7 mounted on a common slider 9 for vertical displacement in the housing part 1 between one side wall thereof and guides 25. A spring 10 braced at its lower end on an abutment 26 in the housing part 1 bears at its upper end on a disk 27 carried on a threaded spindle 28 accessible from outside the housing part 1 through a hole 29. This spring 10 normally urges the slider 9 upwardly so that the shoes 7 bear inwardly against the rollers 4' and brake them. These rollers 4' have central non-illustrated grooves in which the rope 5 is received.

The housing parts 1 and 2 are pivoted together at their upper ends about a horizontal pivot 14 extending parallel to the rotation axes of the rollers 4' and 4''. At their lower ends the housing parts 1 and 2 are secured by respective horizontal pivot bolts 23 and 22 defining a horizontal pivot axis lying in a vertical plane perpendicular to the vertical plane of pivot 14 to a scissor linkage 15. This linkage 15 comprises a pair of first links **15*a* and 15*b* having upper ends pivoted on blocks 22' and 23' carried on the bolts 22 and 23 and are pivoted together at intersection 15*c*. Second links 18 and 19 are respectively connected to the links 15*a* and 15*b* and are pivoted together at 16 where they carry an eye 17 adapted to support a load, normally a person carried in a bosun's chair. These second links 18 and 19 carry respective handles 20 and 21. The user descending the rope 5 by means of the apparatus according to this invention holds the handles 20 and 21** to stabilize himself or herself.

The handle 21 carries an operating lever 8 connected to a Bowden-cable core 12 received in a Bowden-cable sheath 13. The sheath is braced against the housing part 1 and the core is connected to a short lever 11 extending through the slider 9. Pulling of the lever down toward the handle 21 pulls the lever 11 down and therefore displaces the slider 9 against the spring 10 and decreases the braking force applied to the rollers 4'. The braking force is normally set in such a manner that without actuation of the handle 8 the device will not slide downwardly on the cable 5, but when this handle 8 is operated it will slide downwardly.

At the lower end of the gap 3 between the parts 1 and 2 the cable passes through a guide 24 having an opening 30. A similar guide 24 is provided at the top of the device. To fit the cable into this arrangement the two housing parts 1 and 2 are swung apart and then closed on the cable. Once a user sits in the bosun's chair supported by the eye 17 opening-up of the housing parts 1 and 2 is impossible so that the device is very safe for use.

Figure 3:
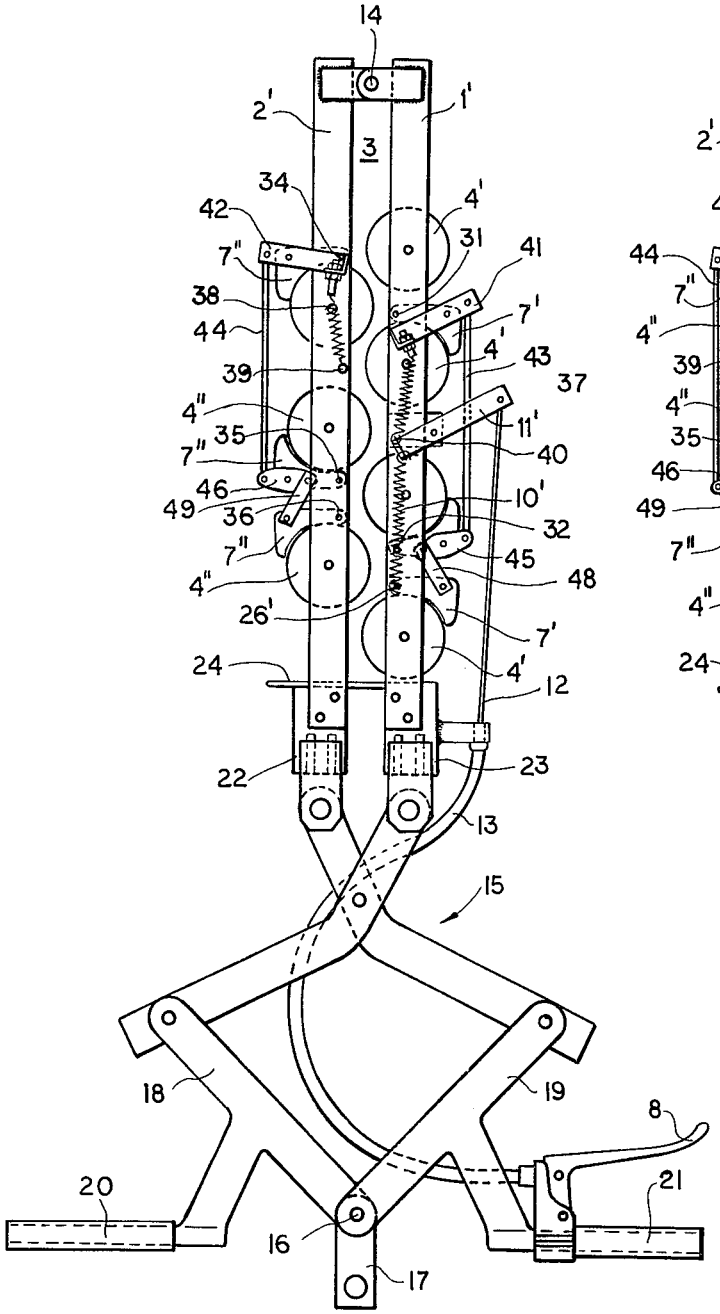
FIGS. 3 and 4 are views of another apparatus according to this invention in the braking and nonbraking positions, respectively.
Figure 4:
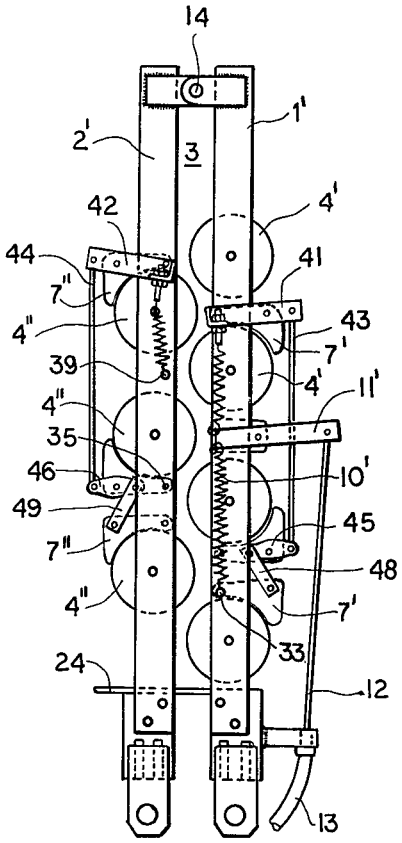

FIGS. 3 and 4 show another arrangement wherein identical reference numerals are used for functionally identical structure. Here the housing is formed of a pair of slotted bars 1' and 2' connected together at the pivot 14 and defining the space 3. At their lower ends these bars are connected via pivot bolts 22 and 23 to the scissor linkage 15. The bar constituting the housing part 1' carries four grooved rollers or wheels 4'' and the bar forming the housing part 2' carries three wheels 4'' interleaved with the wheels or rollers 4'. Each of the rollers 4' except for the uppermost roller 4' is associated with a respective brake shoe 7' pivoted at respective pivots 31–33 on the housing part 1'. The rollers 4'' are each associated with a respective brake shoe 7' pivoted at respective pivots 34–36 on the housing part 2'.

A compression spring 38 is braced between an abutment or anchor 39 on the housing part 2' and an adjustment bolt carried on a two-arm lever 42 pivoted on the uppermost brake shoe 7''. A link 44 connects the other arm of this lever 42 to one arm of a two-arm lever 46 pivoted on the middle brake shoe 7''. The other arm of this lever 46 is connected via a rigid link 49 to the lowermost brake shoe 7''. The pivot 35, but not the pivots 34 or 36, lies relative to the normal direction of rotation of the respective wheel 4″ behind the engagement surfaces of the respective jaw or brake shoe 7″. Thus this middle brake shoe 7″ will act in a self-tightening or self-actuating manner. Under normal circumstances the tension spring 38 will pull the respective arm of the lever 42 so as to pull the uppermost brake shoe 7′ against its respective wheel 4″, while simultaneously pulling the lever 46 in such a direction as to urge the middle brake shoe 7″ against its wheel 4″ and also to urge the lowermost brake shoe 7″ against its wheel 4″. As the forces will be balanced across all three of these brake shoes 7″ even wear will result.

A similar arrangement of a lever 41, rigid link 43, two-armed lever 45, and link 48 is provided for the brake shoes 4′, the uppermost brake shoe 4′ rotating freely on the housing part 1′. Here, however, a tension spring 37 hooked via a screw to the one arm of the two-arm lever 41 is hooked at its other end over an abutment 40 on a two-arm lever 11′ pivoted on the housing part 1′ and having its other end connected to the core 12 of the Bowden cable 12, 13. Another tension spring 10′ is hooked into this anchor or abutment 40 and is hooked to an anchor 26′ on the housing part 1′ so as normally to pull the lever 11′ in a direction raising the operating lever 8. Thus, absent actuation of lever 8, the springs 10′ and 37 will pull in a direction having the same effect as the tension spring 38.

When the operating handle 8 is depressed the lever 11′ is rotated, clockwise as seen in FIG. 4, so as to relieve tension on the spring 37 and allow the shoes 7′ to back slightly off the respective rollers 4′. The result is, of course, decreased friction on these rollers 4′ so that the entire device can descend more rapidly. Otherwise the functioning of the embodiment of FIGS. 3 and 4 is identical to that of FIGS. 1 and 2.

I claim:

1. An apparatus for descending a vertical strand, said apparatus comprising:

a pair of laterally spaced housing parts adapted to flank said strand;

an upper pivot forming an upper pivot axis between said housing parts;

respective pluralities of rollers on said housing parts engageable with a strand between said housing parts;

a scissor linkage having at least two pivoted-together crossing links and having a pair of upper ends and a pair of lower ends, whereby on movement of said lower ends toward and away from each other said upper ends synchronously also move toward and away from each other;

means connecting said upper ends of said linkage each to a respective housing part below said pivot axis;

a pair of handles operatively each connected to a respective lower end of said linkage; and brake means for retarding rotation of at least some of said rollers and including an operating lever carried on one of said handles.

2. The apparatus defined in claim 1 wherein said means connecting said upper ends to said housing parts includes pivots defining horizontal lower pivot axes generally perpendicular to said upper pivot axis, whereby said linkage can swing about said lower pivot axes relative to said housing parts.

3. The apparatus defined in claim 1, further comprising means attached to said lower ends of said linkage for suspending a load and drawing said lower ends together with a force proportional to said load.

4. The apparatus defined in claim 3 wherein said scissor linkage includes said two crossing links each having one end pivoted on the respective housing part, an opposite end, and central part pivoted with the other link, and two further links each having one end pivoted on the opposite end of a respective one of the first-mentioned links and another end pivoted with the other end of the other second-mentioned link, said means for suspending said load being attached to said other ends of said second links, said handles being mounted on said second links.

5. The apparatus defined in claim 1 wherein said brake means includes a plurality of brake shoes each engaging a respective one of said rollers, and means including a spring for continuously urging said shoes against the respective rollers.

6. The apparatus defined in claim 5 wherein said brake means includes means connected between said operating lever and said spring for reducing the force said spring applies to said shoes on actuation of said lever, whereby on actuation of said lever said apparatus will move more rapidly down said strand.

7. The apparatus defined in claim 5 wherein at least some of said brake shoes are pivoted on the respective housing part, said rollers normally rotating in a predetermined rotational sense on displacement of said apparatus down said strand, at least some of said brakeshoes engaging the respective shoes ahead of their respective pivots relative to said rotational sense, whereby said some brakeshoes are self-tightening.

8. The apparatus defined in claim 7 wherein said brake means includes a two-arm lever pivoted on one of said brakeshoes and having one end operatively connected to another of said brakeshoes and another end operatively connected to said spring.

9. The apparatus defined in claim 1 wherein said brake means includes a continuously operating brake effective on the rollers of one of said housing parts and another brake operable by said lever.

10. The apparatus defined in claim 1 wherein said rollers rotate on said parts about roller axes generally parallel to said upper pivot axis.

* * * * *